US005920902A

United States Patent [19]

Crampton

[11] Patent Number: 5,920,902

[45] Date of Patent: Jul. 13, 1999

[54] KNEE PADS FOR WORK PANTS

[75] Inventor: Richard H. Crampton, Gresham, Oreg.

[73] Assignee: Working Concepts, Inc., Portland, Oreg.

[21] Appl. No.: 09/074,557

[22] Filed: May 7, 1998

[51] Int. Cl.[6] ..... A41D 13/00; A41D 1/06; A41D 27/20

[52] U.S. Cl. ..... 2/24; 2/23; 2/237; 2/247

[58] Field of Search ..... 2/24, 22, 23, 231, 2/247, 267, 237

[56] References Cited

U.S. PATENT DOCUMENTS 105,856 7/1870 Sloan .
514,576 2/1894 Walthers et al. .
3,348,241 10/1967 Dodds .
4,561,124 12/1985 Thompson .
5,134,726 8/1992 Ross .
5,617,587 4/1997 Marchbanks .
5,737,775 4/1998 Schwartz .
5,809,576 9/1998 Huston et al. .

*Primary Examiner*—Michael A. Neas
*Assistant Examiner*—Shirra L. Jenkins
*Attorney, Agent, or Firm*—Smith-Hill and Bedell

[57] ABSTRACT

A flexible closed-cell knee pad is held in place between the inside of the knee area of work pant leg and a rectangular fabric piece that is glued to pant leg. Since the fabric is attached to the pant leg by adhesive it is easy to install the knee pad on any kind of work pant without special tools or skills.

2 Claims, 2 Drawing Sheets

KNEE PADS FOR WORK PANTS

BACKGROUND OF THE INVENTION

1. Field of the Invention

The present invention relates in general to knee pads and particular to a method and apparatus for attaching knee pads to work pants.

2. Description of Related Art

When you kneel on a flat surface much of your weight is borne by a small area of each knee, and you subject those areas of your knees to high pressure. Such pressure can damage your knees if you spend long periods in the kneeling position. Knee pads can protect your knees from that high pressure by distributing your weight over wider areas of the knees. They also help to protect the knees and shins from bumps. Some knee pads extend downward to provide additional protection for the shins. A common shin injury results from standing on a step ladder for long periods with the shins pressed against a higher tread of the ladder. The tread puts potentially damaging pressure on a small area of the shin. Shin pads distribute the force from the tread over a wider area of the shins to reduce the pressure on the shins.

Despite the protection that knee and shin pads provide, many workers don't use them. Conventional knee and shin pads are uncomfortable in part because they must be strapped to the user's leg as taught, for example, in U.S. Pat. No. 1,172,552 issued Feb. 22, 1916 to Pierce, U.S. Pat. No. 5,297,294 issued Mar. 29, 1994 Washiek, U.S. Pat. No. 4,876,475 issued Oct. 31, 1989 to Richards, and U.S. Design Pat. No. 278,470 issued Apr. 23, 1985. Whether you strap a pad to your leg outside or inside your pant leg, the straps must hold the pad snugly to your leg to keep it in place. The straps or constricted pant legs are irritating and can reduce air flow around your legs. The straps can also reduce blood circulation in your leg.

U.S. Pat. No. 1,657,452 issued Dec. 27, 1927 to Bradley and U.S. Pat. No. 5,611,081 issued Mar. 18, 1997 to Torres, and U.S. Pat. No. 4,920,577 issued May 1, 1990 to Scharf each disclose work pants with built-in knee pads. The knee pads are inserted into cloth pockets sewn over the outside of the knee areas of the pant legs. Since the pads are affixed to the wearer's pant legs, the pads are held in place without uncomfortable straps. Also when the wearer is not kneeling, the pads move away from the wearer's leg so that air can more freely circulate under the pad. Bradley's knee pads are not removable from the pockets and would be difficult to dry after they get wet. Torres provides an opening in the knee pad pocket to allow the pad to be removed and squeezed dry when it gets wet. Torres uses a Velcro-like material to close the opening when the knee pad is in place. In the Scharf work pant, the pocket includes a large opening at the lower edge of the pocket though which the pad may be inserted or removed. The pad normally stays in the pocket by friction, but may work its way out of the opening from time-to-time. Also the large opening is prone to snagging on objects the wearer brushes against.

None of the knee pad systems described by the above-mentioned patents are particularly well-suited to being quickly and easily attached to existing pants since they all require sewing to the pant leg. Also each knee pad system, when retrofitted to a work pant, has what many would consider to be an obvious and negative impact on the appearance of the work pant.

It would be beneficial to provide a knee pad system for a work pant that could be easily attached to the work pant, that does not affect the appearance of the work pant, that will not allow a knee pad to work its way free of the work pant, and that need not be removed for washing or drying.

SUMMARY OF THE INVENTION

In accordance with the present invention, a flexible closed-cell knee pad is held in place between the inside of the knee area of work pant leg and a rectangular fabric piece that is glued to pant leg.

Since the fabric is glued to the pant leg, it is quick and easy to install the knee pad on any kind of work pant without special tools or skills.

Since the knee pad is made of closed-cell foam, it does not absorb water and therefore need not be removed from the pocket for washing or drying.

Since the knee pad is permanently affixed to the pant legs it won't work its way free of the pant leg under heavy use.

Since the fabric piece is glued to the inside of the pant legs, it has no affect on the external appearance of the work pant and is not subject to snagging on external objects.

It is accordingly an object of the invention to provide an inexpensive means for comfortably protecting a wear's knees and upper shins.

It is another object of the invention to provide a knee pad system for a work pant that can be easily and quickly attached to a work pant without special tools or skills.

It is a further object of the invention to provide a method for attaching a knee pad to a work pant in a manner that does not affect the external appearance of the work pant.

It is a still further object of the invention to provide a knee pad that is permanently attached to the work pants and need not be removed for drying.

The concluding portion of this specification particularly points out and distinctly claims the subject matter of the present invention. However those skilled in the art will best understand both the organization and method of operation of the invention, together with further advantages and objects thereof, by reading the remaining portions of the specification in view of the accompanying drawing(s) wherein like reference characters refer to like elements.

BRIEF DESCRIPTION OF THE DRAWING(S)

DESCRIPTION OF THE PREFERRED EMBODIMENT(S)

Figure 1:
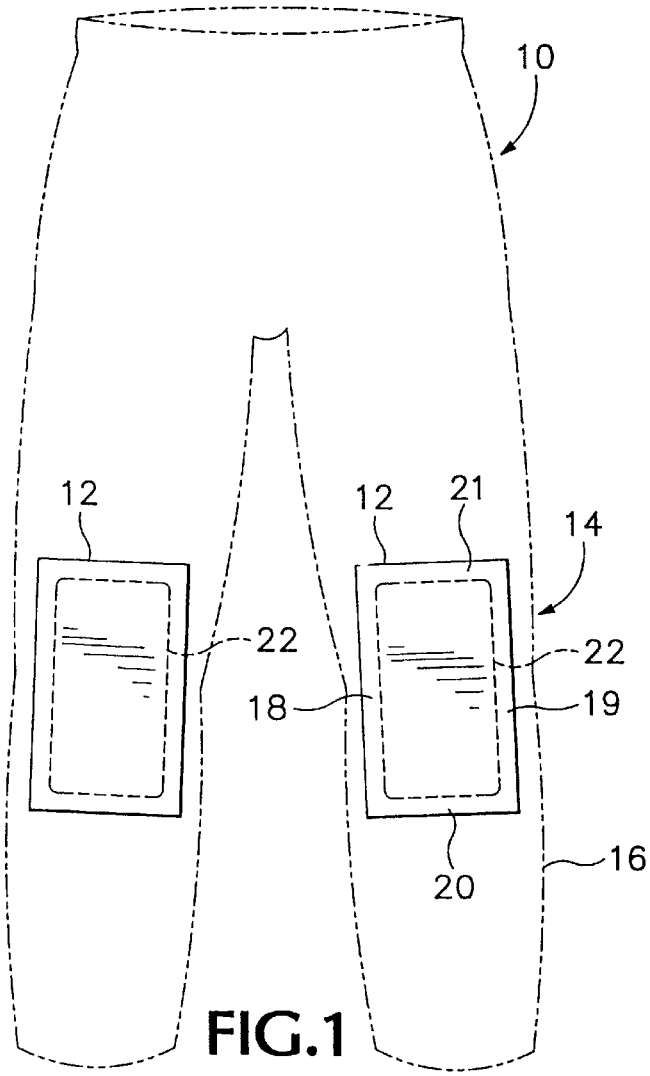
FIG. 1 is a pictorial view of a work pant turned inside out to which has been attached a protective knee pad system in accordance with the present invention attached thereto.
Figure 2:
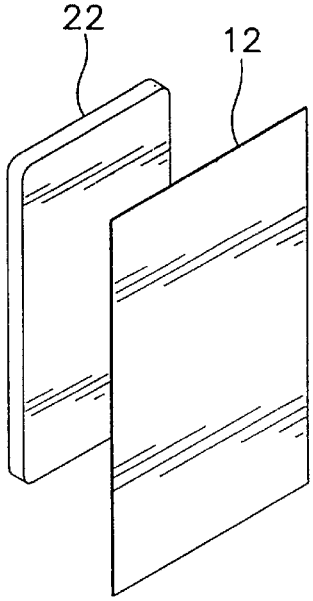
FIG. 2 is an exploded view of the protective knee pad system of FIG. 1.

FIG. 1 illustrates a work pant 10, shown turned inside out, with a rectangular fabric piece 12 attached in accordance with the present invention, to the knee area 14 of the inside surface of each pant leg 16. Each fabric piece 12 is attached with a strong, water resistant fabric adhesive to pant leg 16 only along its four edge margins 18–21 to provide a space between a central portion of pant leg 16 and fabric piece 12 for receiving a rectangular, closed-cell foam knee pad 22. FIG. 2 is an exploded view of fabric piece 12 and pad 20 before they are installed on work pant 10. Pad 22 may be inherently planar as illustrated in FIG. 2 or may have a small natural curve to conform to the natural curve of pant leg 16 when worn.

Figure 3:
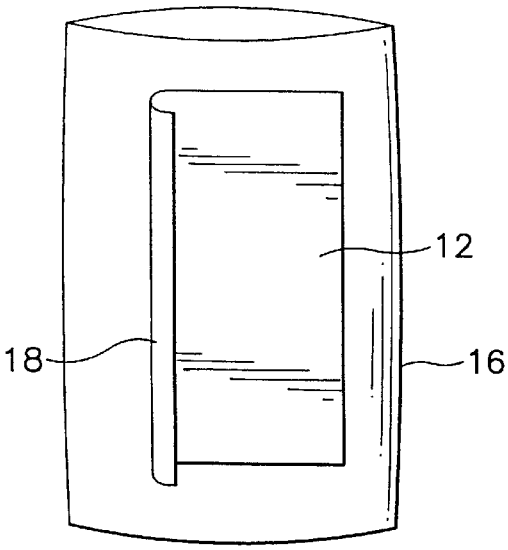
FIGS. 3–7 are pictorial views illustrating the sequence of steps for attaching a knee pad to a work pant in accordance with a method of the present invention.

FIGS. 3–6 illustrate steps in installing fabric piece 12 and knee pad 22 on the inside of one of pant legs 16 of FIG. 1. As illustrated in FIG. 3, the installer first turns pant leg 16 inside out and lays it on a flat surface. The installer then places fabric piece 12 in position over the knee area 14 of pant leg 16 and turns over vertical margin 18 of fabric piece 12. After applying glue to margin 18, the installer turns it back down and presses it to pant leg 16 so as to attach margin 18 thereto.

Figure 4:
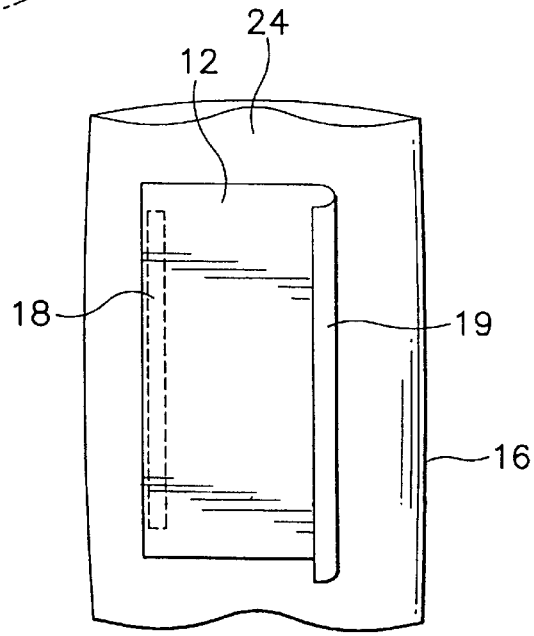

As illustrated in FIG. 4, the installer then turns over opposite vertical margin 19 of fabric piece 12 and applies glue to it. The installer next pulls margin 19 to the right about ¼", thereby putting some slack in area 24 of pant leg 16 under fabric piece 12. The installer then turns down glued margin 19 and presses it to pant leg 16 to affix it thereto.

Figure 5:
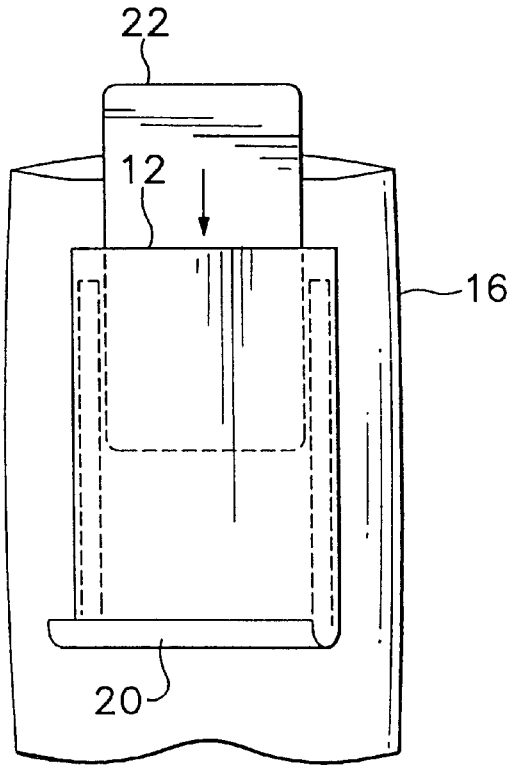

As illustrated in FIG. 5, the installer then inserts a pad 22 into the space between fabric piece 12 and pant leg 16. The installer next turns over bottom margin 20, applies glue to it and then presses its back down to attach it to pant leg 16.

Figure 6:
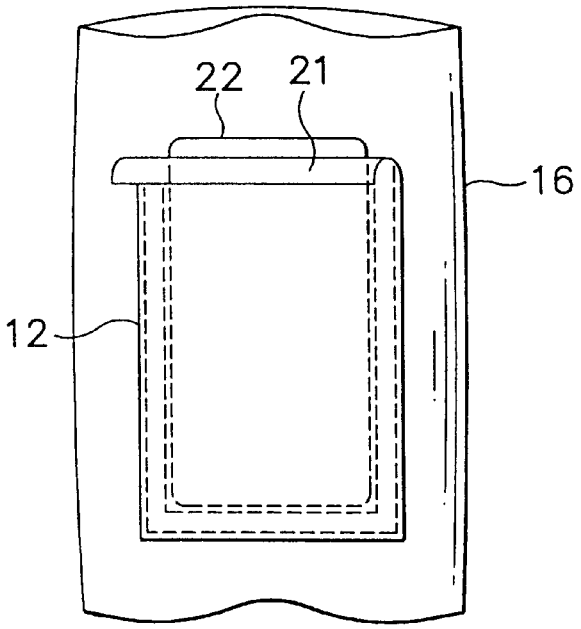

Finally, as illustrated in FIG. 6, the installer turns over and applies glue to top margin 21, then turns it back down and presses it to firmly attach it to pant leg 16.

Figure 7:
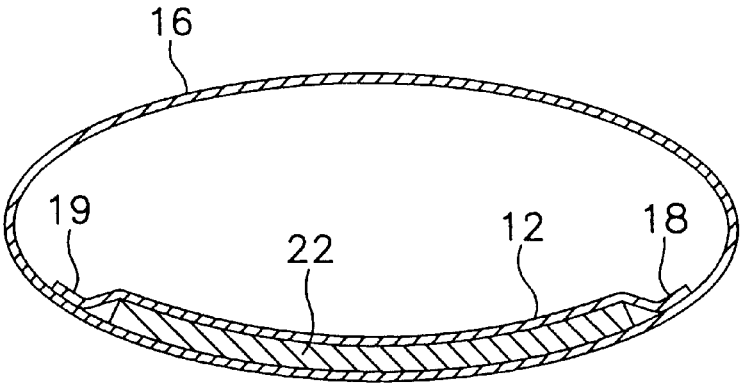

When the installer thereafter turns pant leg 16 outside-out, the slack area 24 shown in FIG. 4 allows pant leg 16 to assume its natural curve as illustrated in the sectional view of FIG. 7 so that the knee pad assembly 12, 22 does not significantly affect the shape of pant leg 16.

If desired, the installer may leave a small gap in the adhesive along the bottom margin 20 of fabric piece 12 to provide a drain path for any water entering the space between fabric piece 12 and pant leg 16.

Work pant 10 and fabric piece 12 are suitably made, for example, of cotton. Val-A Chicago, Inc. brand "Tear-mender" or similar latex adhesive is a suitable adhesive for attaching margins of fabric piece 12 to pant 10 when they are made of cotton or many other natural fibers that readily absorb the adhesive, cure and bond quickly to a waterproof latex rubber.

Thus has been shown and described a method and apparatus for attaching a knee pad to a work pant. Since fabric piece 12 is attached with adhesive to pant leg 16, it is quick and easy to install the pad assembly 12, 22 on any kind of work pant without special tools or skills. Since pad 22 is made of closed-cell foam, it does not absorb water and therefore need not be removed from the pocket for drying. Since the pad 22 is permanently affixed to the pant leg 16 it won't work its way free of the pant leg under heavy use. And with the knee pad assembly 12, 22 is attached to the inside of pant leg 16 in the manner described above, it has no substantially noticeable affect on the external appearance of work pant 10. Also, being attached to the inside of pant leg 16, the pad assembly 12, 22 is not subject to snagging on external objects.

While the forgoing specification has described preferred embodiment(s) of the present invention, one skilled in the art may make many modifications to the preferred embodiment without departing from the invention in its broader aspects. The appended claims therefore are intended to cover all such modifications as fall within the true scope and spirit of the invention.

What is claimed is:

1. A method for affixing a pad to a pant leg comprising the steps of:

turning said pant leg inside out, and attaching edge margins of a fabric piece to an inside surface of said pant leg with said pad held between said fabric piece and said inside surface of said pant leg, wherein said edge margins of said fabric piece are attached to said inside surface of said pant leg by adhesive, wherein said fabric piece is substantially rectangular having opposing first and second vertical edge margins and opposing top and bottom edge margins and wherein the step of attaching said edge margins of said fabric piece to said inside surface of said pant leg with said pad held between said fabric piece and said inside surface of said pant leg comprises the substeps of:

flattening the fabric piece onto said inside surface of said pant leg, applying said adhesive to said first vertical edge margin and pressing said first vertical edge margin onto said inside surface so that said adhesive adheres said first vertical edge margin to said inside surface, applying said adhesive to said second vertical edge margin and pressing said second vertical edge margin onto said inside surface so that said adhesive adheres said second vertical edge margin said inside surface, inserting said pad between said fabric piece and said inside surface of said pant leg, applying said adhesive to one of said top and bottom edge margins and pressing it onto said inside surface so that said adhesive adheres said one of said top and bottom edge margins to said inside surface, applying said adhesive to another of said top and bottom edge margins and pressing it onto said inside surface so that said adhesive adheres said another of said top and bottom edge margins to said inside surface.

2. The method in accordance with claim 1 further comprising the step of:

pulling said second vertical edge margin in a direction away from said first edge margin before pressing said second vertical edge margin onto said inside surface to adhere it there to thereby to produce slack in said inside surface of said pant leg between areas of its attachment to said first and second vertical edge margins.

* * * * *